US005990800A

United States Patent [19]

Tamaki et al.

[11] Patent Number: 5,990,800

[45] **Date of Patent: *Nov. 23, 1999**

[54] REMOTE ENGINE STARTING AND STOPPING DEVICE FOR CONSTRUCTION MACHINE

[75] Inventors: Hideo Tamaki, Oyama; Toyoichi Ono, Atsugi; Hiroshi Oshima, Yokohama; Tasuku Nakano, Komaki; Toshiaki Nawa, Nagoya; Yuji Fukano, Inuyama, all of Japan

[73] Assignee: Komatsu Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/836,559

[22] PCT Filed: Nov. 16, 1995

[86] PCT No.: PCT/JP95/02343

§ 371 Date: Jan. 20, 1997

§ 102(e) Date: Jan. 20, 1997

[87] PCT Pub. No.: WO96/15364

PCT Pub. Date: May 23, 1996

[30] Foreign Application Priority Data

Nov. 16, 1994 [JP] Japan ..... 282064

[51] Int. Cl.[6] ..... G08B 21/00

[52] U.S. Cl. ..... 340/679; 307/10.6; 123/179.2; 180/272; 364/424.34

[58] Field of Search ..... 340/679, 825.69, 340/825.31, 426, 429, 825.39, 825.15; 307/10.2, 10.5, 10.4, 10.6; 364/424.034; 123/179.2; 180/272

[56] References Cited

U.S. PATENT DOCUMENTS

| | | | |
|---|---|---|---|
| 4,080,537 | 3/1978 | Bucher | 290/38 R |
| 4,227,588 | 10/1980 | Biancardi | 180/167 |
| 4,621,375 | 11/1986 | Simnovec | 359/144 |
| 4,674,454 | 6/1987 | Phairr | 123/170 B |
| 5,042,439 | 8/1991 | Tholl et al. | 123/179 B |
| 5,067,321 | 11/1991 | Miyaoka | 60/426 |
| 5,721,550 | 2/1998 | Lopez | 341/176 |
| 5,757,086 | 5/1998 | Nagashima | 307/10.6 |

FOREIGN PATENT DOCUMENTS

| | | |
|---|---|---|
| 1277745 | 12/1990 | Canada . |
| 63-277858 | 11/1988 | Japan . |
| 439145 | 2/1992 | Japan . |
| 5130686 | 5/1993 | Japan . |
| 549867 | 2/1994 | Japan . |
| 622545 | 3/1994 | Japan . |
| 6147069 | 5/1994 | Japan . |
| 712560 | 3/1995 | Japan . |
| 771281 | 3/1995 | Japan . |

*Primary Examiner*—Edward Lefkowitz
*Assistant Examiner*—Davetta Woods
*Attorney, Agent, or Firm*—Greer, Burns & Crain, Ltd.

[57] ABSTRACT

The invention relates to a device which aims to improve safety and reliability in a remote engine starting and stopping device for construction machines. A starting signal for starting an engine is transmitted to a construction machine from a transmission which is separate from the construction machine. The starting signal is received by a receiver on the construction machine. When the starting signal is received by the receiver, an engine starting device is driven for starting of an engine on condition that an operating lever for a working machine being on a neutral position is detected by a neutral position detection. As a result, a danger of the working machine coming into motion in an unmanned state is avoided for improvement of safety. Further, if the engine having worked is detected by a working condition detection after an engine starting device is driven by the engine start, the engine is made to work until a predetermined period of time elapses after a point of time when the detection is effected. As a result, warm-up is performed for a preset time after a point of time when the engine is actually made to work, so that reliability in unmanned operation is improved.

6 Claims, 6 Drawing Sheets

REMOTE ENGINE STARTING AND STOPPING DEVICE FOR CONSTRUCTION MACHINE

TECHNICAL FIELD

The present invention relates to what is called a remote engine starter whereby a vehicle engine can be started from a remote location, and in particular relates to a remote engine starter suitable for construction machines.

BACKGROUND ART

Remote engine starters in which an electromagnetic wave is sent to an automobile by a transmitter, this is received by a receiver in the automobile, and the automobile engine is started by driving a self-starter motor in response to this received signal are already well known for automobiles (automatic vehicles).

Such a remote engine starter enables the engine to be started to perform warm-up operation before setting out on a busy morning without needing to go to the location of the automobile itself; this is convenient and saves time.

Wheel loaders and similar construction machines are often employed in severe natural environments such as extreme cold. There is therefore a particularly great demand in such cold regions for the ability to start the engine so that warm-up operation can be completed before going to the site of the construction machine.

However, the mode of operation and work performed by the operator in a construction machine differ from that of an ordinary automobile. Furthermore, while ordinary automobiles mainly employ gasoline engines, construction machines use diesel engines.

Consequently, if the remote engine starters that are employed in automobiles were to be applied without modification to construction machines, there would be a risk that safety might be impaired in that the working machines of construction machines should not be in motion unattended, as well as reduced reliability in that there would be no positive indication as to whether the diesel engine had actually been started or stopped.

DISCLOSURE OF THE INVENTION

With the foregoing in view, it is an object of the present invention to provide a remote engine starting and stopping device suitable for construction machines.

An object of the first aspect of the present invention is to improve safety by avoiding the risks that might occur with a construction machine if a working machine were allowed to move in an unattended condition.

This object is achieved by a remote engine starting and stopping device for a construction machine, which is capable of starting an engine incorporated in the construction machine from a remote location and stopping an operation of the engine after a prescribed time has elapsed, and which comprises:

- transmitting means separate from the construction machine, for transmitting a start signal for starting the engine to the construction machine, wherein the construction machine comprises:
- receiving means for receiving the start signal transmitted from the transmission means;
- safety condition detecting means for detecting that a safety condition for unmanned operation of the construction machine is satisfied; and

- engine starting means for driving a starting device of the engine when the start signal is received by the receiving means and when the safety condition detecting means detects that the safety condition for unmanned operation of the construction machine is satisfied.

Also, an object of a second aspect of the present invention is to improve the reliability of unmanned operation by performing warm-up operation for a prescribed time from the time point where the engine was actually operated.

This object is achieved in that the construction machine further comprises:

- operating condition detecting means for detecting that the engine is in an operating condition; and
- timer means, when the operation condition detecting means detects that the engine has been operated after the engine starting device has been driven by the engine starting means, causes the engine to operate from the time point of the detection until a prescribed time has elapsed.

Also, an object of a third aspect of the present invention is to improve reliability of unmanned operation by outputting an alarm signal to that effect if the engine has not stopped after a prescribed time has elapsed.

This object is achieved in that the construction machine further comprises:

- engine stopping means for driving a stopping device of the engine;
- operating condition detecting means for detecting that the engine is in an operating condition;
- timer means for causing the engine stopping means to drive the engine stopping device at a time point where a prescribed time has elapsed after driving of the engine starting device by the engine starting means; and
- alarm signal output means for outputting an alarm signal indicating that the engine has not stopped when, after the engine stopping device has been driven by the engine stopping means, the operating condition detecting means detects that the engine is operating.

Also, an object of a fourth aspect of the present invention is to improve reliability of unmanned operation by warming-up a working machine of the construction machine for a prescribed time, whilst the engine is being warmed up.

This object is achieved in that the construction machine further comprises:

- heater means for raising a temperature of a working oil of a working machine of the construction machine;
- first timer means for causing the engine stopping means to drive the engine stopping device at a time point where a prescribed time has elapsed after the engine starting device has been driven by the engine starting means; and
- second timer means for putting the heater means in ON condition until the prescribed time has elapsed after the engine starting device has been driven by the engine starting means.

With the construction of the first aspect of the present invention, a start signal for starting the engine is transmitted to the construction machine from the transmitting means, which is separate from the construction machine. This start signal is then received by the receiving means of the construction machine.

When the start signal is received by the receiving means, the starting device of the engine is driven and the engine is driven under the condition that the safety condition detecting means detects that the safety condition for unmanned operation of the construction machine is satisfied. As a result, safety is improved in that the risks which may occur at the construction machine such as the working machine moving while unmanned are avoided.

Also, with the construction of the second aspect of the present invention, after the engine starting device has been driven by the engine starting means, when the operation condition detecting means detects that the engine has been operated, the engine is operated from the time point of this detection until a prescribed time elapses. As a result, the reliability of unmanned operation is improved in that warm-up operation is performed for a prescribed time from the time point where the engine actually began operating.

Also, with the construction of the third aspect of the present invention, further, the engine stopping device is driven by the engine stopping means at the time point where a prescribed time has elapsed from the driving of the engine starting device by the engine starting means. Also, when, after the engine stopping device has been driven by the engine stopping means, the operating condition detecting means detects that the engine is operating, an alarm signal is output indicating that the engine has not stopped. As a result, the reliability of unmanned operation is improved in that, if the engine is not stopped after a prescribed time has elapsed, a warning signal to that effect is output.

Also, with the construction of the fourth aspect of the present invention, the engine stopping device is driven by the engine stopping means at the time point where a prescribed time has elapsed from the time when the engine starting device was driven by the engine starting means. The heater means is also put into an ON condition until the lapse of a prescribed time from the driving of the engine starting device by the engine starting means. As a result, reliability of unmanned operation is improved in that the working machine of the construction machine is also warmed up for the prescribed time whilst the engine is being warmed up.

BEST MODE FOR CARRYING OUT THE INVENTION

An embodiment of a remote engine starting and stopping device for a construction machine according to the present invention is described below with reference to the drawings.

Figure 1:
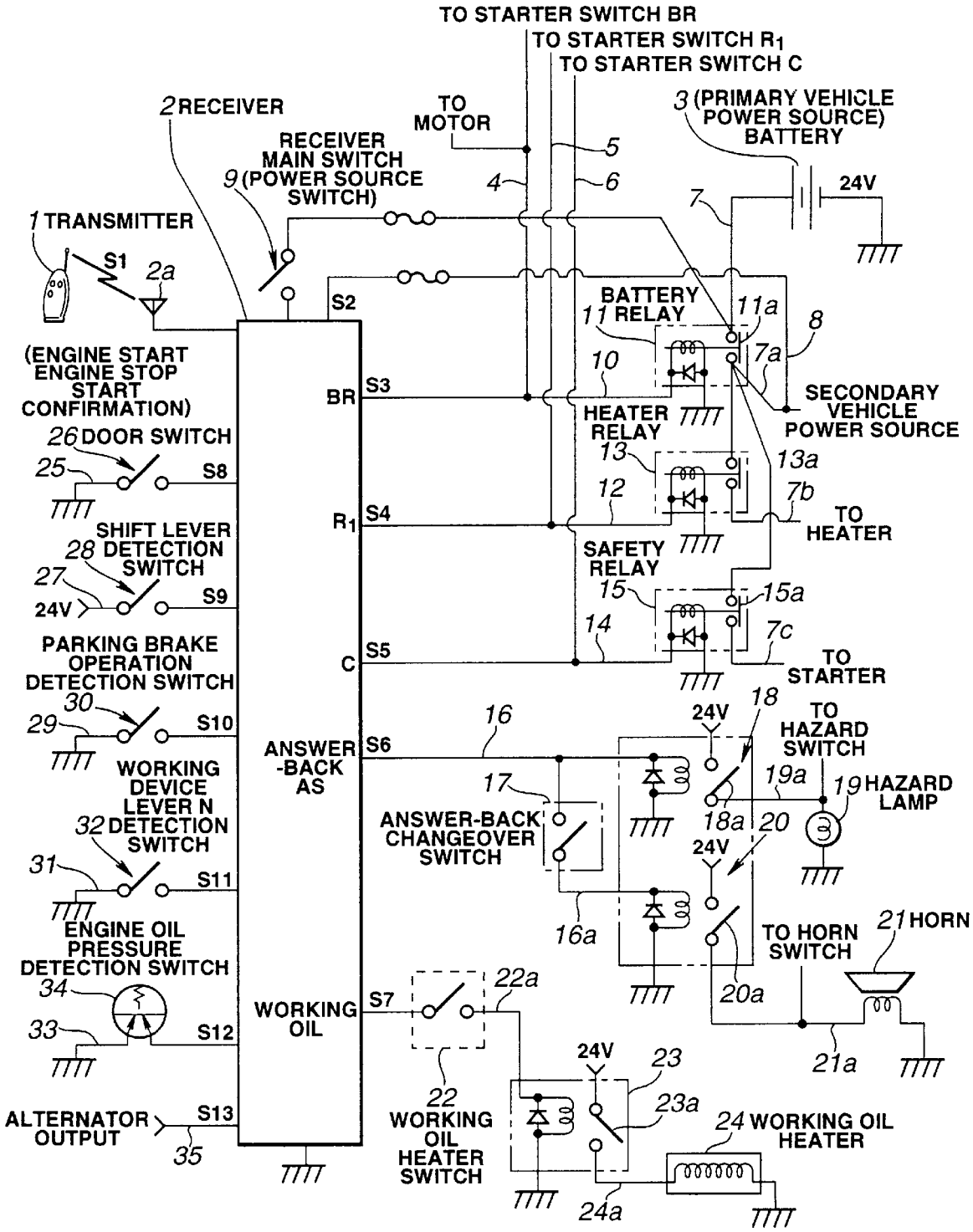
FIG. 1 is a circuit diagram showing the construction of an embodiment of a remote engine starting and stopping device for a construction machine according to the present invention.

FIG. 1 is a circuit diagram showing the layout of an embodiment device. Transmitter 1 shown in this Figure is separate from the construction machine (vehicle) such as a wheel loader, and is constructed so that it can be carried by a person. Receiver 2 is mounted on the construction machine.

Transmitter 1, on being operated by the operator, sends to receiver 2 mounted in the construction machine an "engine start" signal, "engine stop" signal, and "engine start confirmation" signal S1, to be described.

When the above signal S1 is received by antenna 2*a* of receiver 2, the CPU in receiver 2 executes processing, to be described.

Receiver 2 is driven using as power source the primary power source of the vehicle 1, for example a battery 3 of voltage 24V. The voltage of battery 3 is applied to receiver 2 through a signal line 7 and receiver main switch (power source switch) 9.

Within the cab of the construction machine, there is provided a starter switch; depending on the respective operating positions "BR", "R1", or "C", current flows to signal lines 4, 5 and 6, current flows to signal lines 10, 12 and 14, and battery relay 11, heater relay 13 and safety relay 15 are energized.

Also, when the starter switch is moved to the "BR" position, a motor driving a governor is driven, causing fuel to be supplied to a diesel engine mounted on the construction machine.

Battery relay 11, heater relay 13 and safety relay 15 are energized in response to processing executed by the CPU, to be described.

In more detail, when current S3 from the "BR" port of receiver 2 flows in signal line 10, contact 11*a* of battery relay 11 is closed, allowing current to flow from battery 3 to signal line 7; this is supplied to receiver 2 through signal lines 7*a* and 8 and constitutes current S2 produced by the secondary power source of the vehicle.

Also, when current S4 from port "R1" of receiver 2 flows to signal line 12, the contact 13*a* of heater relay 13 is closed, allowing current to flow from battery 3 to signal lines 7, 7*b*; this current is supplied to the heater (plug) of an engine preheating device.

Also, when current S5 from port "C" of receiver 2 flows to signal line 14, contact 15*a* of safety relay 15 is closed, allowing current to flow from battery 3 to signal lines 7, 7*c*; this current is supplied to the starter, which constitutes the starting device of the engine.

Also, when current S6 from port "AS" for answer-back, to be described, of receiver 2 flows in signal line 16, contact 18*a* of relay 18 is closed, allowing current to flow from battery 3 to signal line 19*a*. As a result, current is supplied to illuminate hazard lamp 19. If answer-back changeover switch 17 is then closed, current S6 flows in signal line 16*a*, with the result that contact 20*a* of relay 20 is closed, allowing current to flow from battery 3 to signal line 21*a*. As a result, current is supplied to actuate horn 21.

Also, when current S7 from port "OL" of receiver 2 flows to signal line 22*a* through working oil heater switch 22, contact 23*a* of relay 23 is closed, allowing current to flow from battery 3 to signal line 24*a*. As a result, current is supplied to working oil heater 24 operating this heater 24.

A door switch 26 that detects door closure is provided in the door of the cab of the construction machine; when door closure is detected by this door switch 26, switch 26 is closed, and a zero-level voltage signal S8 indicating this fact is input to receiver 2 through signal line 25.

Furthermore, a gear lever for selecting the running gear of the construction machine is provided in the cab of the construction machine. A gear lever N detection switch 28 that detects when the neutral position N is selected is attached to this gear lever. If the fact that neutral position N has been selected is detected by this switch 28, switch 28 is closed, and a signal S9 of voltage 24V indicating the fact that it is closed is input to receiver 2 through signal line 27.

Also, a parking brake operating element (for example an operating lever) that operates a parking brake that fixes the wheels or track of the construction machine is arranged in the cab of the construction machine. A parking brake actuation detection switch 30 that detects actuation of the parking brake is attached to this parking brake operating element. When actuation of the parking brake is detected by this switch 30, switch 30 is closed, and a signal S10 of zero-level voltage indicating the fact that it is closed is input to receiver 2 through signal line 29.

A working machine (such as a bulldozer device) of the construction machine is operated by a working machine operating element (for example an operating lever) provided in the cab. The drive speed of the working machine is changed in accordance with the operating position of this working machine lever. A working machine lever N detection switch 32 that detects the fact that the operating position is at the neutral position N for which the drive gear ratio of the working machine is zero is attached to this working machine lever. When the fact that this is positioned in the neutral position N is detected by this switch 32, switch 32 is closed, and a signal S11 of zero-level voltage indicating the fact that it is closed is input to receiver 2 through signal line 31.

On a pressurized oil conduit whereby oil to lubricate the engine of the construction machine is fed under pressure, there is provided an engine oil detection switch 34 that detects the fact that the pressure of the oil in the conduit has fallen below a prescribed threshold value i.e. that the engine has stopped. When this switch 34 detects the fact that the engine has stopped, switch 34 is closed and a signal S12 of zero-voltage level indicating that it has closed is input to receiver 2 through signal line 33.

Also, when the engine of the construction machine is driven, the alternator is driven, generating electricity, with the result that the current S13 is input to receiver 2 through signal line 35. That is, the fact that the engine is operating is detected by the input of signal S13.

Next, the processing performed by the CPU of receiver 2 will be described with reference to FIG. 2 to FIG. 6 taken in conjunction.

Figure 2:
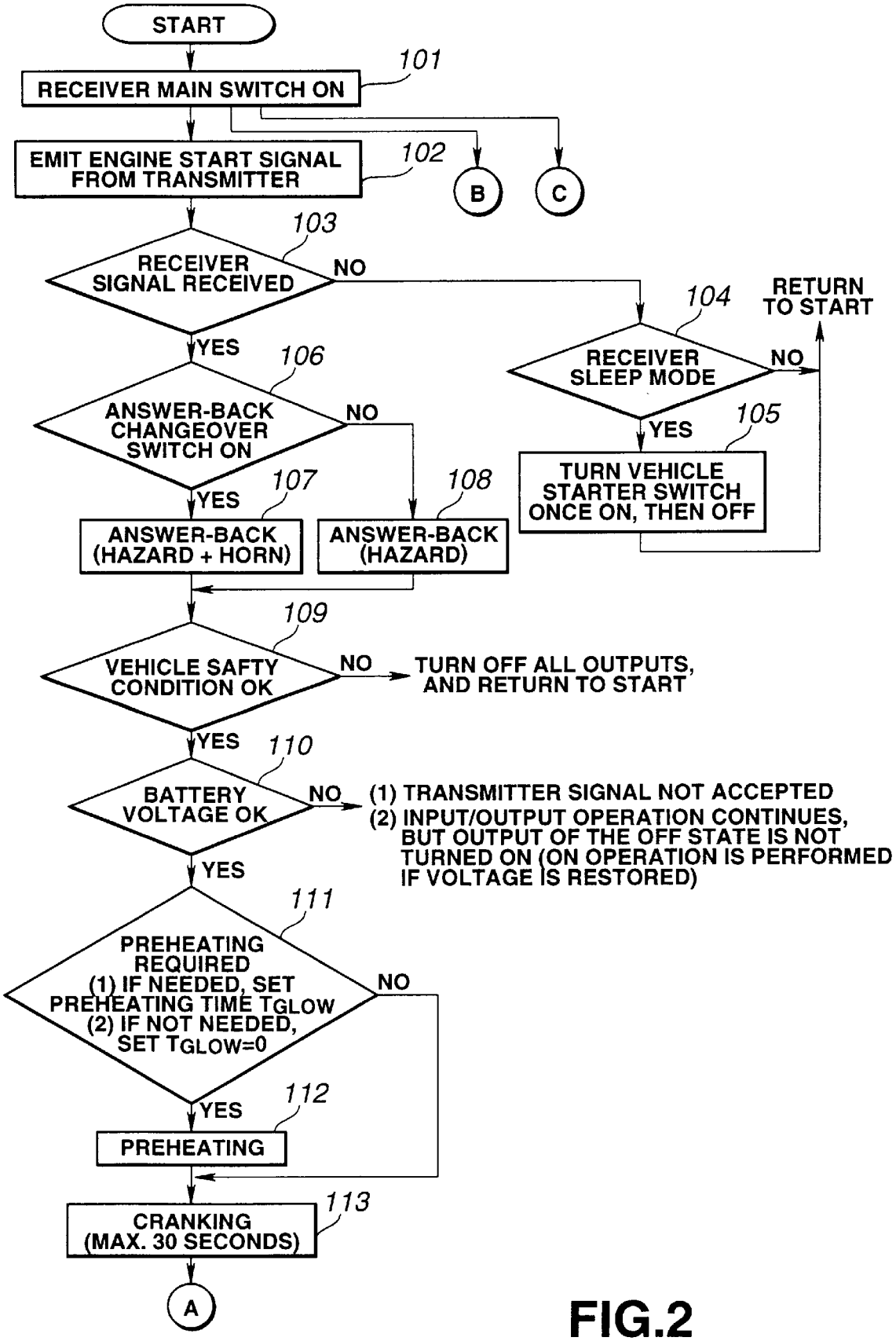
FIG. 2 is a flow chart showing a processing sequence of the embodiment.
Figure 3:
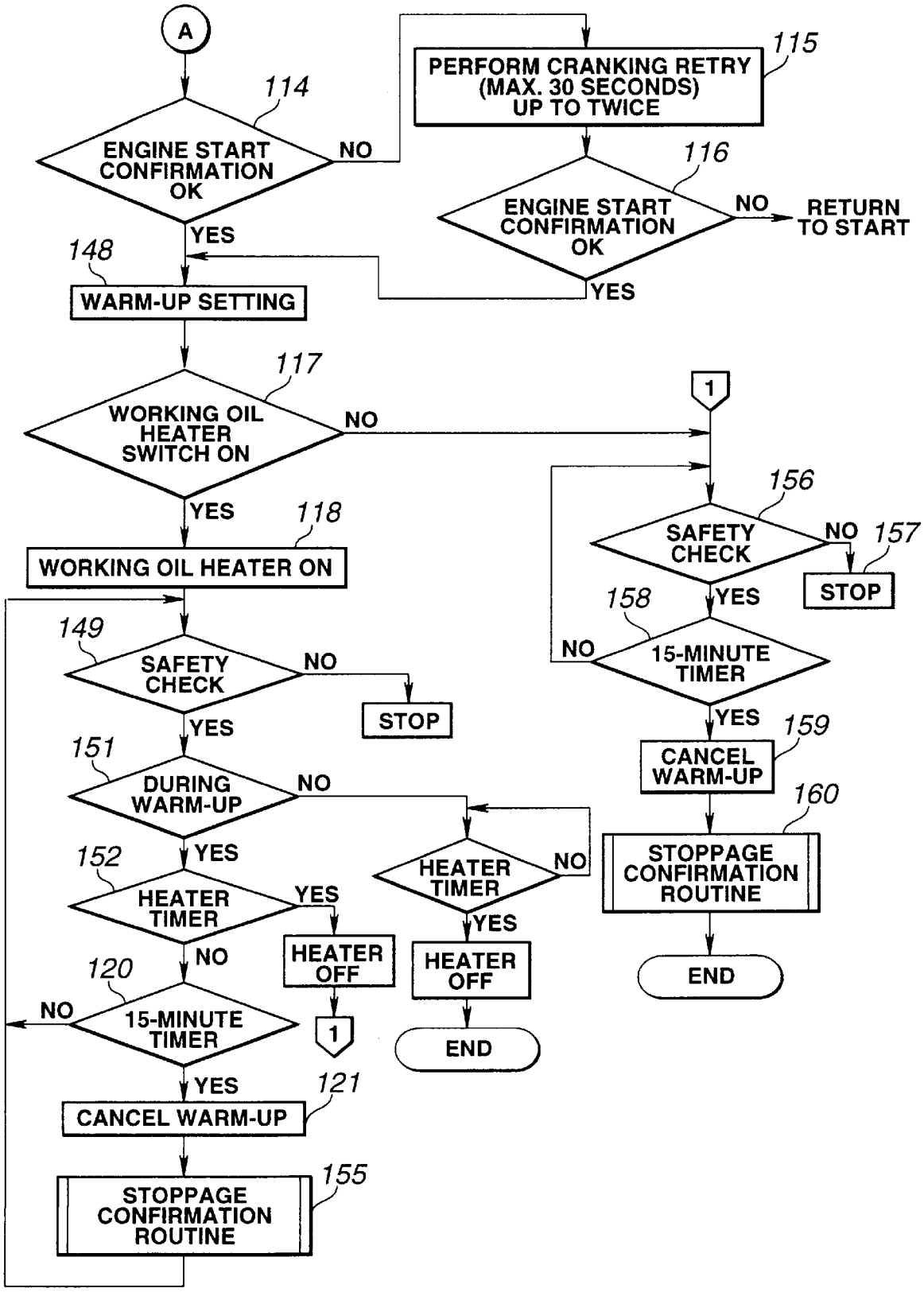
FIG. 3 is a flow chart showing a processing sequence of the embodiment.

First of all, when, as shown in FIG. 2, receiver 2 is driven by the power source constituted by battery 3 by turning ON (closing) main switch 9 of receiver 2 (step 101), the following processing is executed, depending on the type of the signal S1 that is sent from transmitter 1.

Case where signal S1 "engine start" is sent.

When the "engine start" signal S1 is sent from transmitter 1 (step 102) and this is received by receiver 2 (decision YES in step 103), the following engine start processing is commenced (steps 106 -). However, if receiver 2 has not received signal S1 (decision NO in step 103), it is ascertained whether or not the receiver is in sleep mode (step 104). If, as a result, it is found that the receiver is not in sleep mode (decision NO in step 104), the procedure returns to the start. And if it is found that the receiver is in sleep mode (decision YES in step 104), the starter switch is turned once ON and then OFF (step 105), after which the procedure returns to the start.

In contrast, if signal S1 is received (decision YES in step 103), signal S3 is output from port "BR", battery relay 11 is energized, and signal S2 is input. When signal S2 is thus input by output of signal S3, the condition in which the "engine start" signal S1 can be received (reception standby condition) is discontinued, and a new condition is produced, in which the "engine start" signal S1 cannot be received.

When answer-back changeover switch 17 is ON (decision YES in step 106), signal S6 is output from port "AS" and relays 18, 20 are both energized, causing hazard lamp 19 to illuminate and horn 21 to sound for a prescribed time (e.g. 0.5 sec). As a result, the operator at the transmitter 1, even though he is at a remote location, can ascertain from this answer-back that the "engine start" signal S1 has been received by receiver 2, thanks to the lighting of the above lamp and sounding of the horn (step 107). The operator at transmitter 1 can likewise obtain an answer-back (step 108) when answer-back changeover switch 17 is OFF (decision NO of step 106), since this causes signal S6 to be output from port "AS", causing only relay 18 of the relays 18 and 20 to be energized, with the result that the lighting of hazard lamp 19 is performed for a prescribed time.

Next, it is ascertained whether or not the safety condition for unattended operation of the construction machine is satisfied.

The safety condition in this case is that all of the following should be satisfied:

(1) The door of the cab is closed;

(2) The neutral position N of the gear lever has been selected;

(3) The parking brake is actuated; and (4) The lever of the working machine is in the neutral position N.

The safety conditions may be specified as required, depending on the type of machine etc., and one or more of the conditions (1)–(4) above may be combined as a safety condition.

If all the conditions (1)–(4) above are satisfied, i.e. if all of signals S8, S9, S10 and S11 are being input to receiver 2 (decision YES in step 109), it is determined that the engine can be started whilst unattended, and the processing of steps 110 et seq. is executed. However, if any one of the above conditions (1)–(4) is unsatisfied (decision NO in step 109), it is determined that there would be a safety problem in starting the engine whilst unattended, so all the outputs are turned OFF, and the procedure returns to the start. The decision process of step 109 is thereafter constantly repeated and, if a decision NO is made, even though the engine is in pre-heating or warming up, all the processing in question is suspended and the condition returns to the initial condition.

If it is determined that there are no vehicle safety problems (decision YES in step 109), it is ascertained (step 110), for example by means of signal S2, whether or not the voltage of battery 3 has reached the specified voltage (24V). As a result, if the voltage of battery 3 is below the specified voltage (decision NO in step 110), processing is performed such that: (1) signals S1 from transmitter 1 are not accepted and (2) although input/output operation continues to be performed, it is not possible to change the output from the OFF condition to the ON condition (however, ON operation is performed once the voltage has been restored). This decision process of step 110 continues to be regularly executed thereafter, so that, as soon as a decision NO is made, the processing of (1) and (2) above is immediately executed.

If the voltage of battery 3 has reached the specified voltage (decision YES in step 110), signal S4 is output from port "R1", energizing heater relay 13 and causing the heater of the pre-heating device of the engine to be operated. As a result, preheating of the engine is performed for a prescribed time TGLOW set by a setting device, not shown (decision YES of step 111, step 112). And if preheating is unnecessary, TGLOW can be set to zero by this setting device, so that the procedure jumps to step 113 without performing preheating (decision NO in step 111).

In step 113, signal S4 is output from port "C", energizing safety relay 15, operating the starter, which performs cranking of the engine for a maximum of 30 seconds (step 113). Cranking is stopped at the time point when it is confirmed that the engine has started (decision YES in step 114).

The condition for confirmation of engine starting in this step 114 is that both of the following should be satisfied:

(a) the engine oil pressure has reached the prescribed threshold value or more; and (b) the alternator is being driven (the engine is rotating).

However, the condition for confirmation of starting could be set at will depending on the type of engine etc., and either one of the above conditions (a) and (b) could be chosen as the starting confirmation condition. Also, another condition could be set up in place of condition (b) above so long as it is able to detect whether the engine is rotating.

If both of the above conditions (a) and (b) are satisfied i.e. if signal S13 is being input but signal S12 is not being input to receiver 2 (decision YES in step 114), this is identified as the condition that the engine has in fact been started and is operating, and the processing of steps 117 et seq. is executed. However, if even one of conditions (a) and (b) is not satisfied (decision NO in step 114), this is identified as being the condition that, although the starter has been operated, the engine was not in fact started and is not in operating condition, and the starter is again operated for up to for example a maximum of 30 seconds. This cranking retry is executed for example a maximum of twice. The cranking time and number of retries can be set at will (step 115).

Engine starting confirmation processing (step 116) is performed during this cranking retry process in the same way as in step 114. If, as a result of this starting confirmation processing, it is determined that the engine is not in fact operating (decision NO in step 116), the procedure returns to the start; however, if it is determined that the engine is in fact operating (decision YES in step 116), the engine warm-up setting flag is set (step 148), and the procedure goes to step 117.

If, at this point, working oil heater switch 22 is ON (closed) (decision YES in step 117), warm-up of the engine and warm-up of the working machine are performed (steps 118–155).

Specifically, the clock of a timer, not shown, is started, and warm-up of the engine is performed for a preset time (for example 15 minutes (step 120). Then, after this set time has passed, the warm-up setting flag is cancelled, and the signal S3 from port "BR" is turned OFF. As a result, the motor that drives the governor is turned OFF, cutting off the supply of fuel to the engine, so that the engine is stopped (step 121).

Figure 4:
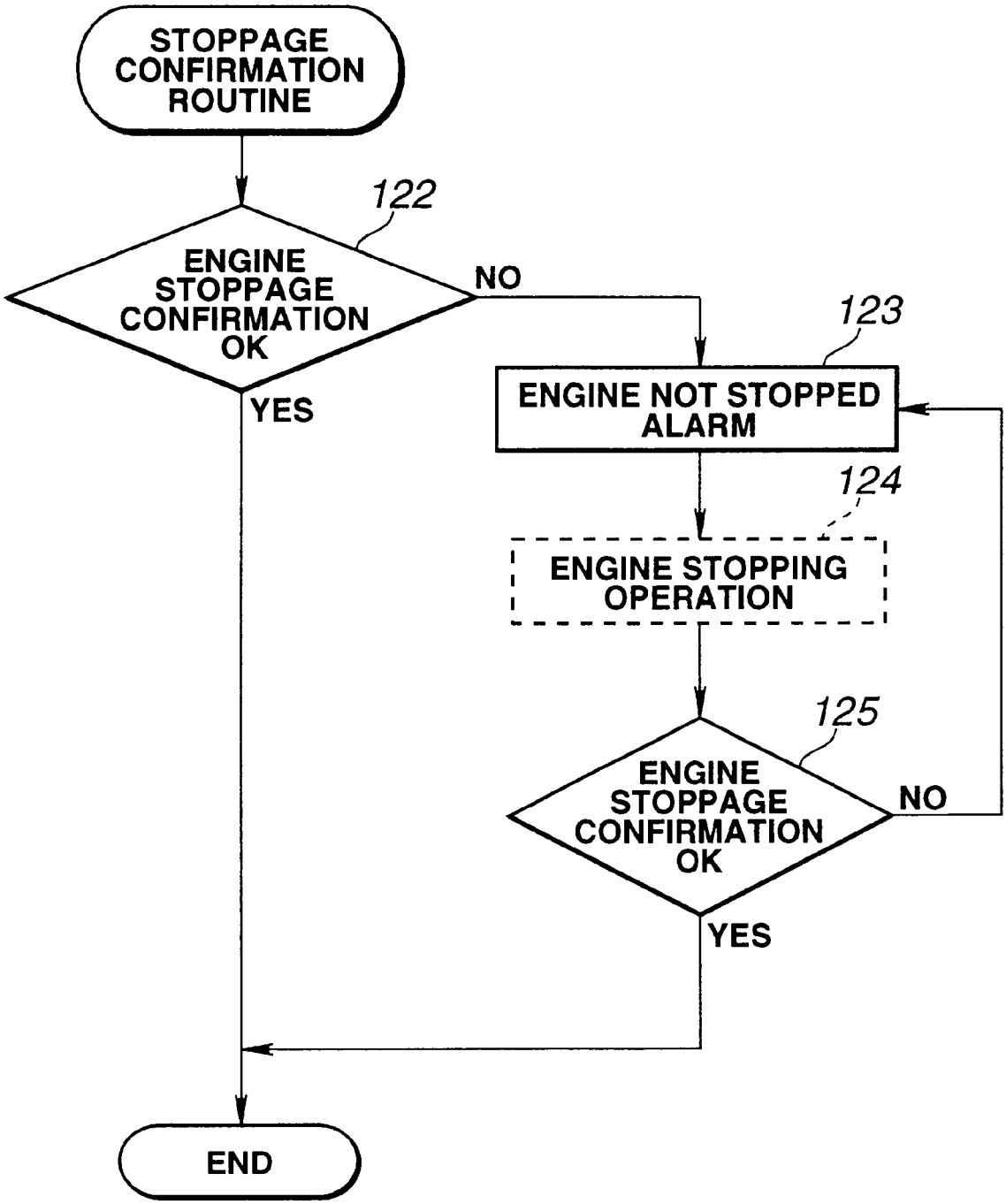
FIG. 4 is a flow chart showing a processing sequence of the embodiment.

Next, the procedure jumps to the stoppage confirmation routine (step 155) and, as shown in FIG. 4, a judgment is made to the effect that the engine has in fact stopped operation, by checking to see that both of the following conditions are satisfied. This means that both of the following conditions for operation stoppage must be satisfied:

(a)' the engine oil pressure must be smaller than a prescribed threshold value; and (b)' the alternator must not be being driven (the engine must not be rotating).

However, the operation stoppage condition can be set at will depending on the type of engine etc. and any one of conditions (a)' or (b)' can be taken as the operation stoppage condition. Also, a different condition can be set in place of condition (b)' so long as it is able to detect that the engine is not rotating.

If both of conditions (a)' and (b)' are satisfied i.e. if signal S12 is being input to receiver 2 but signal S13 is not being input (decision YES in step 122), it is determined that the engine has in fact stopped and is not in operating condition; all processing is therefore terminated. However, if any one of above conditions (a)' and (b)' is not satisfied (decision NO in step 122), this is interpreted as representing the condition where, although fuel supply to the engine has been cut off, the engine has not in fact stopped and is still in operating condition; an alarm to the effect that "engine has not stopped" is therefore output. This alarm is effected (step 123) by for example intermittently lighting or sounding hazard lamp 19 and horn 21. By this means, even though the operator is in a remote location, he can clearly ascertain that the engine has not stopped, and take appropriate action (step 124).

After this, engine stoppage confirmation processing is performed as in step 122, and if confirmation of engine stoppage is obtained (decision YES in step 125), all processing is terminated; however, if confirmation of engine stoppage is not obtained (decision NO in step 125), the procedure again jumps to step 123 and the same processing is repeated.

If signal S7 is output from port "OL" and working oil heater switch 22 is ON (closed) (decision YES in step 117), relay 23 is energized, causing working oil heater 24 to be operated. The operating time of this working oil heater 24 is preset. As a result, the temperature of the working oil of the working machine rises, so that warm-up of the working machine is performed for the time set by the heater timer (steps 118, 152, and 153); after this set time has elapsed, working oil heater 24 is turned OFF (steps 154, 119).

The working machine is fully warmed up by this rise in temperature of the working oil produced by working oil heater 24. It should be noted that, if the warm-up setting flag is set, engine warm-up is continued after heater 24 is turned OFF (decision YES of step 151, steps 152, 154, 156–160), while, if the warm-up setting flag is cancelled, all processing is terminated after heater 24 is turned OFF (decision NO of step 151, steps 153, 119).

In addition, a safety check is constantly performed whilst the engine is being warmed up (step 149). This safety check consists in checking to see whether the above-mentioned start confirmation conditions (a), (b) and the above-mentioned conditions (1)–(4) are all satisfied.

If the above safety conditions (1)–(4) are no longer being satisfied, this means that the operator has entered the cab and commenced manned operation. Also, if the above start confirmation conditions (a) and (b) are no longer being satisfied, this means that for example some problem with the engine has occurred.

Accordingly, where any one of the checking items (1)–(4), (a) or (b) of the safety check has ceased to be satisfied, this is to be taken as indicating either that manned operation has commenced or that some engine problem or the like has occurred: for example, even within the clock period of the timer (for example a set time of 15 minutes) of warm-up operation, the engine may be stopped immediately for safety reasons (step 150).

It should be noted that, for the check items of the safety check, any combination of conditions (1)–(4), (a), or (b) could be selected. For example, it would be possible to take only conditions (a) and (b) as the safety check items.

Also, if working oil heater switch 22 is OFF (open) (decision NO in step 117), only engine warm-up is performed (steps 156–160). In steps 156, 157, 158, 159 and 160, the same processing is executed as in steps 149, 150, 120, 121 and 155 described above.

When engine warm-up is completed, as described above, the output of signal S3 from port "BR" is turned OFF (steps 121, 159), and receiver 2 is restored to a condition in which it can once more receive the "engine start" signal S1 (reception standby condition). Case where "engine stop" signal S1 is transmitted.

Figure 5:
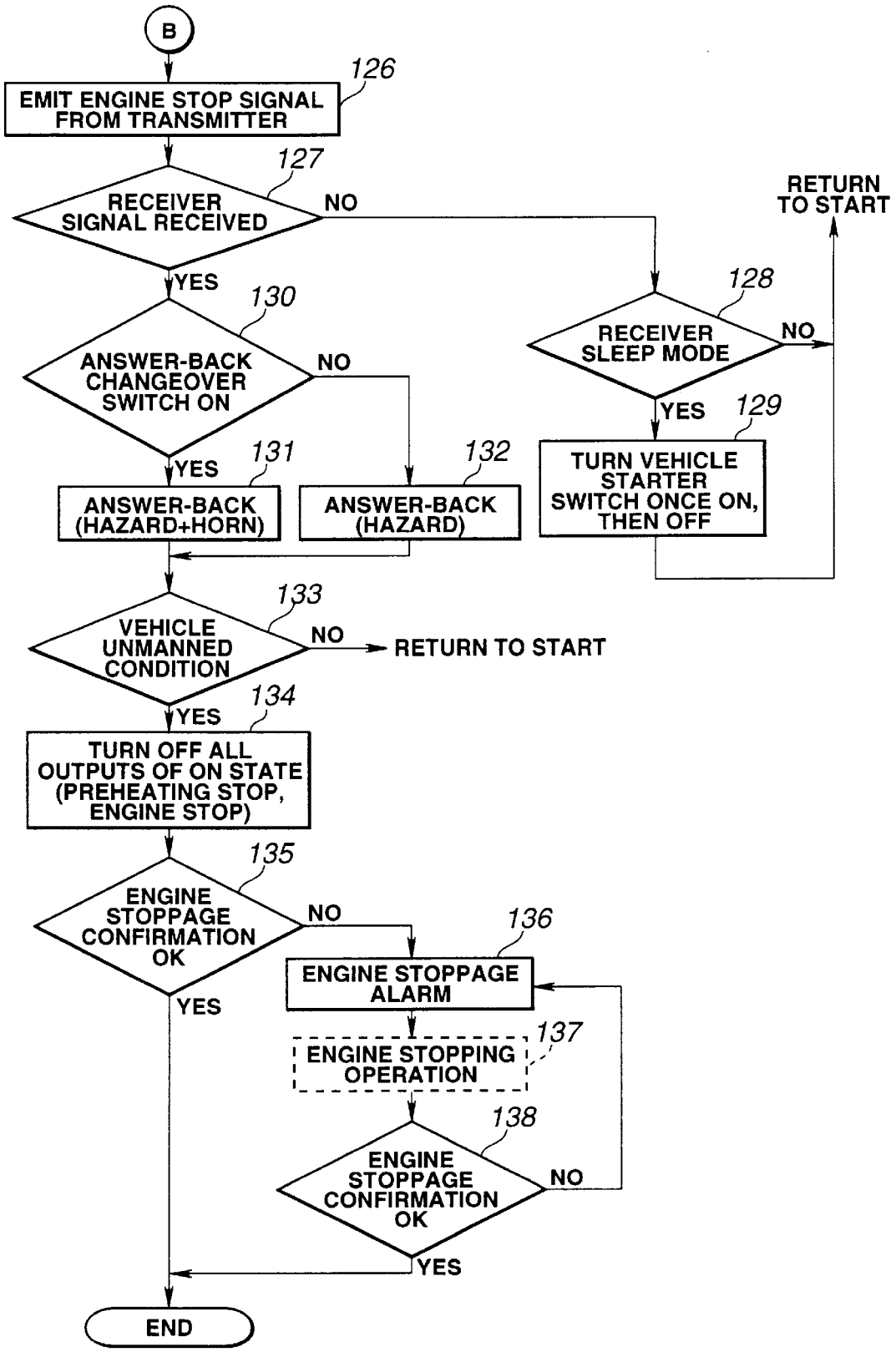
FIG. 5 is a flow chart showing a processing sequence of the embodiment.

In this case, as shown in FIG. 5, an "engine stop" signal S1 is transmitted from transmitter 1 (step 126); when this is received by receiver 2 (decision YES in step 127), the subsequent engine stop processing is commenced (steps 130 -), but, if receiver 2 has not received this signal S1 (decision NO in step 127), a determination is made as to whether the receiver is in sleep mode or not (step 128). If the result of this is that it is found that the receiver is not in sleep mode (decision NO in step 128), the procedure returns to the start. And if it is determined that the receiver is in sleep mode (decision YES in step 128), the start switch is turned once ON and then OFF (step 129), after which the procedure returns to the start.

On the other hand, if signal S1 has been received (decision YES in step 127), if answer-back changeover switch 17 is ON (decision YES in step 130), signal S6 is output from port "AS", relays 18 and 20 are both energized and lighting of hazard lamp 19 and sounding of horn 21 are performed for a prescribed time. As a result, the operator at transmitter 1, even though he is in a remote location, is able to know (step 131) that the "engine stop" signal S1 has been received by receiver 2, thanks to the answer-back constituted by this lighting of the lamp and sounding of the horn. Likewise, if answer-back changeover switch 17 is OFF (decision NO in step 130), signal S6 is output from port "AS" and, of relays 18 and 20, only relay 18 is energized, lighting hazard lamp 19 for a prescribed time and thereby enabling an answer-back to be furnished to the operator at transmitter 1 (step 132).

Next, a determination is made as to whether or not a person has got into the cab of the construction machine i.e. whether it is in unmanned condition or not. The conditions in this case are:

(i) that battery relay 11 is energized; and (ii) that receiver 2 is not in a condition in which it can receive the "engine start" signal S1 (i.e. it is not in signal standby condition).

The situation that both of the above conditions (i) and (ii) are satisfied means that a condition obtains in which the engine is operating in response to an "engine start" signal S1 sent from transmitter 1 (unmanned warm-up condition) (decision YES in step 133). In cases other than this, in other words in the condition where the operator has got into the vehicle and the engine is being operated under the control of the operator, or in the condition in which the engine is stopped (decision NO in step 133), the procedure returns to the start.

It should be noted that, apart from above conditions (i) and (ii), any condition could be set that enables the unmanned warm-up condition to be identified. For example, by arranging a pressure sensor in the operator's seat, absence of the operator could be ascertained in accordance with the detected value of this pressure sensor.

If both of the above unmanned warm-up condition determination conditions (i) and (ii) are satisfied (decision YES in step 133), it is concluded that the engine can now be stopped, and all outputs are turned OFF. In other words, even if the engine is undergoing preheating in response to the "engine start" signal S1, or is in the course of warming up, these processes are all suspended (step 134).

Next, the fact that the engine has in fact stopped its operation is confirmed in the same way as in step 122 above. As a result, if each of the conditions (a)' and (b)' is satisfied, i.e. if signal S12 is being input while signal S13 is not being input to receiver 2 (decision YES in step 135), it is concluded that the engine is in fact stopped and is not in operating condition, so all processing is terminated. However, if any one of above conditions (a)', (b)' is not satisfied (decision NO in step 135), it is concluded that, although the supply of fuel to the engine has been cut off, the engine has still in fact not stopped and is in operating condition, and an alarm to the effect that "engine has not stopped" is output. This alarm is effected by for example intermittent lighting or sounding of hazard lamp 19 and horn 21 (step 136). Even though he is at a remote location, the operator is thereby able to clearly recognize that the engine has not stopped, and can take appropriate action (step 137).

After this, engine stoppage confirmation processing is performed in the same way as in step 135; if engine stoppage is confirmed (decision YES in step 138), all processing is terminated. However, if engine stoppage is not confirmed (decision NO in step 138), the procedure again jumps to step 136, and the same processing is repeated.

Case where an "engine start confirmation" signal S1 is sent.

Figure 6:
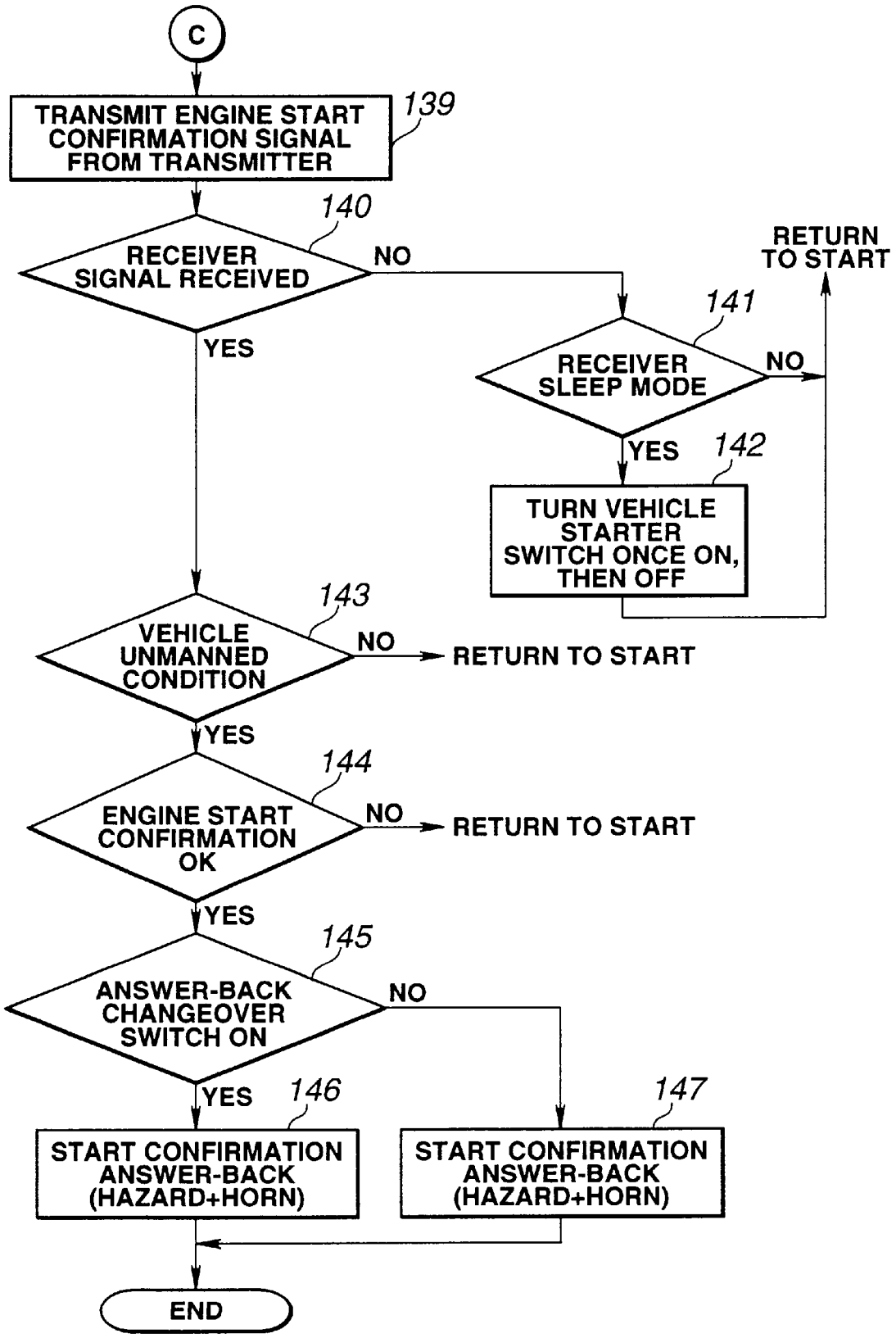
FIG. 6 is a flow chart showing a processing sequence of the embodiment.

In this case, as shown in FIG. 6, when an "engine start confirmation" signal S1 is sent from transmitter 1 (step 139), and this is received by receiver 2 (decision YES in step 140), the subsequent engine start confirmation processing is commenced (steps 143 -). However, if this signal S1 has not been received by receiver 2 (decision NO in step 140), a determination is made as to whether or not the receiver is in sleep mode (step 141). If, as a result, it is found that the receiver is not in sleep mode (decision NO in step 141), the procedure returns to the start. And if it is determined that the receiver is in sleep mode (decision YES in step 141), the start switch is turned ON once and then OFF (step 142), after which the procedure returns to the start.

If signal S1 is received (decision YES in step 140), just as in step 133 above, a determination is made as to whether a person has entered the cab of the construction machine or not i.e. as to whether it is in unmanned condition or not. If, as a result, it is found that at least one of the above conditions (i), (ii) of the unmanned warm-up condition is unsatisfied (decision NO in step 143), it is concluded that the construction machine is not in a condition in which start processing has been commenced in response to an "engine start" signal S1, and the procedure returns to the start.

However, if both of conditions (i) and (ii) of the above unmanned warm-up condition are satisfied (decision YES in step 143), it is concluded that start processing has commenced in response to an "engine start" signal S1, and engine start confirmation processing is then performed in the same way as in step 114 above. As a result, if each of conditions (a) and (b) above is satisfied i.e. if signal S12 is not being input to receiver 2 but signal S13 is being input (decision YES in step 144), it is concluded that the engine has actually started and is in operating condition, and the answer-back processing of step 145 et seq. is executed; however, if any of conditions (a), (b) is not satisfied (decision NO in step 144), it is concluded that, although the starter has operated, the engine did not in fact start and is not in operating condition, and the procedure returns to the start.

For this answer-back processing, the same processing as in steps 130, 131 and 132 is performed, so that, even though the operator is in a remote location, the operator can still confirm "engine start" (steps 145, 146 and 147).

As described above, with the present invention, it is arranged that warm-up operation of an unattended engine can only be performed if the conditions for unmanned operation of the construction machine are satisfied, in particular, the condition that the operating element that operates the working machine is in the neutral position; consequently, the risk which can arise at the construction machine of the working machine of the construction machine being moved whilst unattended is eliminated, resulting in an enormous improvement in safety.

Also, since the processing for warm-up of an unattended engine is proceeded with whilst performing detection as to whether the engine is actually operating or not, the reliability of the remote starting and stopping device for a construction machine incorporating a diesel engine is enormously improved.

INDUSTRIAL APPLICABILITY

The present invention can also be applied to construction machines using gasoline engines.

We claim:

1. A remote engine starting and stopping device for a construction machine, which is capable of starting an engine incorporated in the construction machine from a remote location and stopping an operation of the engine after a prescribed time has elapsed, the device comprising:

transmitting means separate from the construction machine, for transmitting a start signal for starting the engine to the construction machine;

wherein the construction machine comprises:

receiving means for receiving the start signal transmitted from the transmission means;

safety condition detecting means for detecting that a safety condition for unmanned operation of the construction machine is satisfied;

engine starting means for driving a starting device of the engine when the start signal is received by the receiving means and when the safety condition detecting means detects that the safety condition for unmanned operation of the construction machine is satisfied;

operation condition detecting means for detecting a plurality of conditions are satisfied which indicate that the engine is rotating normally; and engine stopping means for driving a stopping device of the engine when, after the engine starting device has been driven by the engine starting means, the operating condition detecting means ceases to detect that the engine is in a rotating condition.

2. The remote engine starting and stopping device for the construction machine according to claim 1, wherein the safety condition is that an operating element for operating a working machine of the construction machine is positioned in a neutral position, and wherein the starting device of the engine is driven when detected that the operating element is positioned in the neutral position.

3. A remote engine starting and stopping device for a construction machine, which is capable of starting an engine incorporated in the construction machine from a remote location and stopping an operation of the engine after a prescribed time has elapsed, the device comprising:

transmitting means separate from the construction machine, for transmitting a start signal for starting the engine to the construction machine;

wherein the construction machine comprises:

receiving means for receiving the start signal transmitted from the transmission means;

safety condition detecting means for detecting that a safety condition for unmanned operation of the construction machine is satisfied;

engine starting means for driving a starting device of the engine when the start signal is received by the receiving means and when the safety condition detecting means detects that the safety condition for unmanned operation of the construction machine is satisfied;

engine stopping means for driving a stopping device of the engine;

operating condition detecting means for detecting a plurality of conditions are satisfied which indicate that the engine is rotating;

timer means for causing the engine stopping means to drive the engine stopping device at a time point where a prescribed time has elapsed after driving of the engine starting device by the engine starting means; and alarm signal output means for outputting an alarm signal indicating that the engine has not stopped when, after the engine stopping device has been driven by the engine stopping means, the operating condition detecting means detects that the engine is operating.

4. A remote engine starting and stopping device for a construction machine, which is capable of starting an engine incorporated in the construction machine from a remote location and stopping an operation of the engine after a prescribed time has elapsed, the device comprising:

transmitting means separate from the construction machine, for transmitting a start signal for starting the engine to the construction machine;

wherein the construction machine comprises:

receiving means for receiving the start signal transmitted from the transmission means;

safety condition detecting means for detecting that a safety condition for unmanned operation of the construction machine is satisfied;

engine starting means for driving a starting device of the engine when the start signal is received by the receiving means and when the safety condition detecting means detects that the safety condition for unmanned operation of the construction machine is satisfied;

unmanned state detecting means for detecting a state in which the engine is rotating in accordance with an engine start signal transmitted from the transmitting means;

unmanned condition detecting means for detecting that the construction machine is in an unmanned condition; and engine stopping means for driving a stopping device of the engine under a condition that the unmanned condition detecting means has detected the unmanned condition, when the stopping signal has been received by the receiving means.

5. A remote engine starting and stopping device for a construction machine, which is capable of starting an engine incorporated in the construction machine from a remote location and stopping an operation of the engine after a prescribed time has elapsed, the device comprising:

transmitting means separate from the construction machine, for transmitting a start signal for starting the engine to the construction machine;

wherein the construction machine comprises:

receiving means for receiving the start signal transmitted from the transmission means;

safety condition detecting means for detecting that a safety condition for unmanned operation of the construction machine is satisfied;

engine starting means for driving a starting device of the engine when the start signal is received by the receiving means and when the safety condition detecting means detects that the safety condition for unmanned operation of the construction machine is satisfied;

unmanned condition detecting means for detecting that the construction machine is in an unmanned condition;

operation condition detecting means for detecting a plurality of conditions are satisfied which indicate that the engine is rotating; and answer back signal outputting means for outputting an answer back signal indicating that the engine is in the rotating condition, under a condition that, when said answer back signal has been received by the receiving means, the unmanned condition detecting means has detected the unmanned condition and the operating condition detecting means has detected that the engine is in the rotating condition.

6. A remote engine starting and stopping device for a construction machine, which is capable of starting an engine incorporated in the construction machine from a remote location and stopping an operation of the engine after a prescribed time has elapsed, the device comprising:

transmitting means separate from the construction machine, for transmitting a start signal for starting the engine to the construction machine;

wherein the construction machine comprises:

receiving means for receiving the start signal transmitted from the transmission means;

safety condition detecting means for detecting that a safety condition for unmanned operation of the construction machine is satisfied;

engine starting means for driving a starting device of the engine when the start signal is received by the receiving means and when the safety condition detecting means detects that the safety condition for unmanned operation of the construction machine is satisfied;

operation condition detecting means for detecting a plurality of conditions are satisfied which indicate that a plurality of conditions are satisfied indicating that the engine is rotating normally;

timer means for causing the engine to operate, when the operation condition detecting means detects that the engine has been operated after the engine starting device has been driven by the engine starting means, from the time point of the detection until a redetermined time has elapsed; and engine stopping means for driving a stopping device of the engine when, after the engine starting device has been driven by the engine starting means, the operating condition detecting means ceases to detect that the engine is in a rotating condition.

* * * * *